US007246455B2

(12) United States Patent
Covington

(10) Patent No.: US 7,246,455 B2
(45) Date of Patent: Jul. 24, 2007

(54) SMART SHOE

(75) Inventor: Larry Covington, 5901 NW. 21 St., Lauderhill, FL (US) 33313

(73) Assignee: Larry Covington, Lauderhill, FL (US)

( * ) Notice: Subject to any disclaimer, the term of this patent is extended or adjusted under 35 U.S.C. 154(b) by 322 days.

(21) Appl. No.: 10/986,538

(22) Filed: Nov. 10, 2004

(65) Prior Publication Data

US 2006/0026869 A1 Feb. 9, 2006

Related U.S. Application Data

(60) Provisional application No. 60/598,863, filed on Aug. 4, 2004.

(51) Int. Cl.
*A43B 23/00* (2006.01)

(52) U.S. Cl. ..... 36/136; 36/112; 36/137; 36/139

(58) Field of Classification Search ..... 36/112, 36/1, 136, 137, 139
See application file for complete search history.

(56) References Cited

U.S. PATENT DOCUMENTS 3,702,999 A * 11/1972 Gradisar ..... 340/573.1
3,777,086 A * 12/1973 Riedo ..... 200/52 R
4,350,853 A * 9/1982 Ganyard ..... 200/52 R
4,771,556 A * 9/1988 Kim ..... 36/139
4,832,606 A * 5/1989 Clark et al. ..... 434/258
5,240,418 A * 8/1993 Silverman et al. ..... 434/260
5,269,690 A * 12/1993 Zigon ..... 434/397
5,530,626 A * 6/1996 Norment ..... 361/814
5,586,888 A * 12/1996 Webb ..... 434/258
5,615,111 A * 3/1997 Raskas et al. ..... 36/136
5,855,080 A * 1/1999 Van Staden ..... 36/139
6,003,212 A * 12/1999 Imahata ..... 24/581.1
6,030,089 A * 2/2000 Parker et al. ..... 362/103
2002/0020082 A1* 2/2002 James ..... 36/112
2005/0223600 A1* 10/2005 Hunter et al. ..... 36/112

* cited by examiner

*Primary Examiner*—Marie Patterson

(57) ABSTRACT

The present invention provides a children shoe that enables children to put shoes on the right feet by matching up the shoe big toe to big toe or heel to heel before putting on the shoe. The smart shoe essentially comprises an engaging portion on the outside of shoe with a pressure activated switch that emits light when switch is pressed the smart shoe also comprises a circuit connected to a switch, a battery and speaker and microprocessor comprising a memory that enables an announcement or other distinctive sounds to be emitted from a speaker.

9 Claims, 5 Drawing Sheets

SMART SHOE

This application claims the benefit of Provisional Application Ser. No. 60/598,863 filed Aug. 4, 2004.

DETAILED DESCRIPTION OF THE EMBODIMENT

Referring now to the drawings, FIGS. 1-5 of the invention which is a shoe, for use in connection with enabling children to put shoe's, on the right feet without the assistance of parent's. The smart shoe "depicted generally as 10, used to protect the feet, may be made of any of the material's known in the art including leather, rubber, plastic and fabric. The smart shoe 10 may be sized for children of all ages. FIG. 1, show's a view of both shoe's 10 of the present invention in a preferred embodiment. The smart shoe 10 comprises a big toe to big toe engaging portion, is a pressure-activated switch 11 connected to a battery 12 and a light emitting circuit that emit light 15 when switch 11 is activated. The smart shoe 10 may also produce the mean's for producing sound may be a speaker 16 and a microprocessor 18 with a memory that enable an announcement or other distinctive sound's to be emitted from a speaker 16 when switch is activated.

FIG. 2. Is a side view of the present invention's alternative embodiment? The smart shoe 10 provide a heel to heel engaging portion is a pressure-activated switch 11 on the heel of shoe 10 and the battery 12 at the front of shoe 10 with all of the same component's and function's as FIG. 1 except the switch 11 and battery 12 is moved around. FIG. 3 is a side view of the present invention preferred embodiment on the big toe side of shoe 10 with all of the same components and functions as FIG. 1. FIG. 4. is a full view of both shoe's 10 of the alternative embodiment comprising a heel to heel engaging portion is a pressure-activated switch 11 connected to a battery 12 and a light emitting circuit that emit light's 15 when switch 11 activated. The smart shoe 10 may also produce sound from a speaker 16 and a microprocessor 18 comprising a memory that enable an announcement or other distinctive sound's to be emitted from a speaker 16 FIG. 5. Is a schematic of the current embodiment of the circuit 17 of the smart shoe, the circuit 17 comprises a switch 11 providing an electrical connection between a battery 12 and a microprocessor 18, the switch 11 could be a simple pressure-activated button, a transducer or another type of small readily available switch in the current embodiment. The circuit 17 is on when the switch is closed or activated, or depressed. The circuit is off when the switch 11 is open or not depressed. The microprocessor 18 may be a simple logic chip or may contain a memory that enables a specific sound to be emitted by a speaker 16. The light 15 and speaker 16 are connected to a battery 12 in order to complete the circuit 17 when the switch 11 is closed or in the on position. When the switch is in the open position power flow to the battery 12 does not flow to the microprocessor 18 so power is conserved and the light 15 and speaker 16 are inactive. When the button-switch 11 is depressed power flow to the microprocessor 18 causes the speaker 16 to sound and the light's to glow. As previously noted, the microprocessor 18 of the current embodiment comprises a memory that enable an announcement or other distinctive sound's to be emitted from the speaker 16 when the switch 11 is closed. The microprocessor may also cause light 15 of the current embodiment of the smart shoe to flash intermittently or independently. Anyone trained in the art will also appreciate that the circuit 17 may also be simplified. For example, the speaker 16 or the light's 15 may be omitted or as in the current embodiment, a plurality of lights may be employed. The speaker 16 may also be replaced with a buzzer, such as a piezoelectric buzzer to produce a buzz rather than a sound. Using a buzzer rather than a speaker would allow the microprocessor 18 with it's associated memory for sound to be eliminated, thus eliminating the microprocessor 18 would further eliminate the control of the light's 15 causing the lights 15 to glow steadily when the switch 11 is closed. In such case if a blinking light is desired, the light 15 could be replaced with a flasher bulb rather than a bulb. Led may be used for the lights 15 to insure longevity. Aside from the variation's herein explained, anyone trained in the art will readily recognize that other variation's of the circuit are possible without deviating from the spirit and scope of the invention. For example the speaker 16 and light 15 may be in a series, rather than in parallel.

As shown in FIG. 1-4, The smart shoe of the present invention may comprise a battery 12 operated speaker 16 to play an announcement or other distinctive sound's from a speaker 16 and microprocessor comprising a memory that enable a sound to be emitted from a speaker 16 when a button 11 is pressed.

While preferred embodiments of the smart shoe of the present invention have been described in detail, it should be apparent that modifications and variations thereto are possible, all of which fall within the scope and spirit of the invention.

The smart shoe may be made of any type of shoe known in the art that is suitable for children including, boot's and sandal's and running shoe's, also of any color.

With respect to the above description of the smart shoe is considered illustrative only, the principles of the invention. Further since numerous modifications and changes will readily occur to those skilled in the art, it is not desired to limit the invention in any way to the exact construction and operation. All suitable modifications and equivalents may be resorted to falling within the scope of the invention.

BRIEF DESCRIPTION OF THE DRAWINGS

For a fuller understanding of the nature of the invention, reference should be made to the following detailed description, taken in connection with the accompanying drawings in which.

Figure 1:
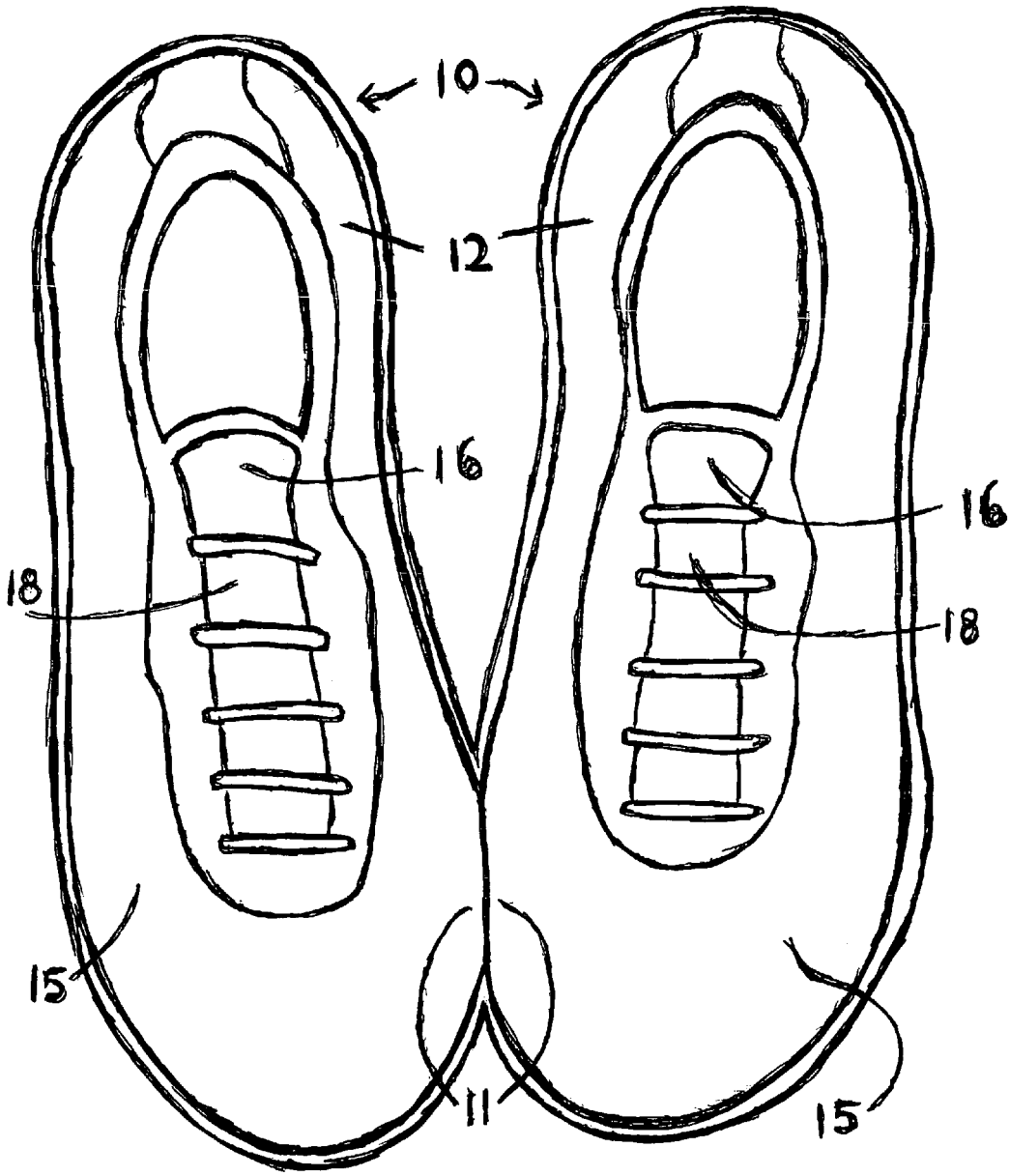
FIG. 1 is a perspective view of the present invention preferred embodiment.
Figure 2:
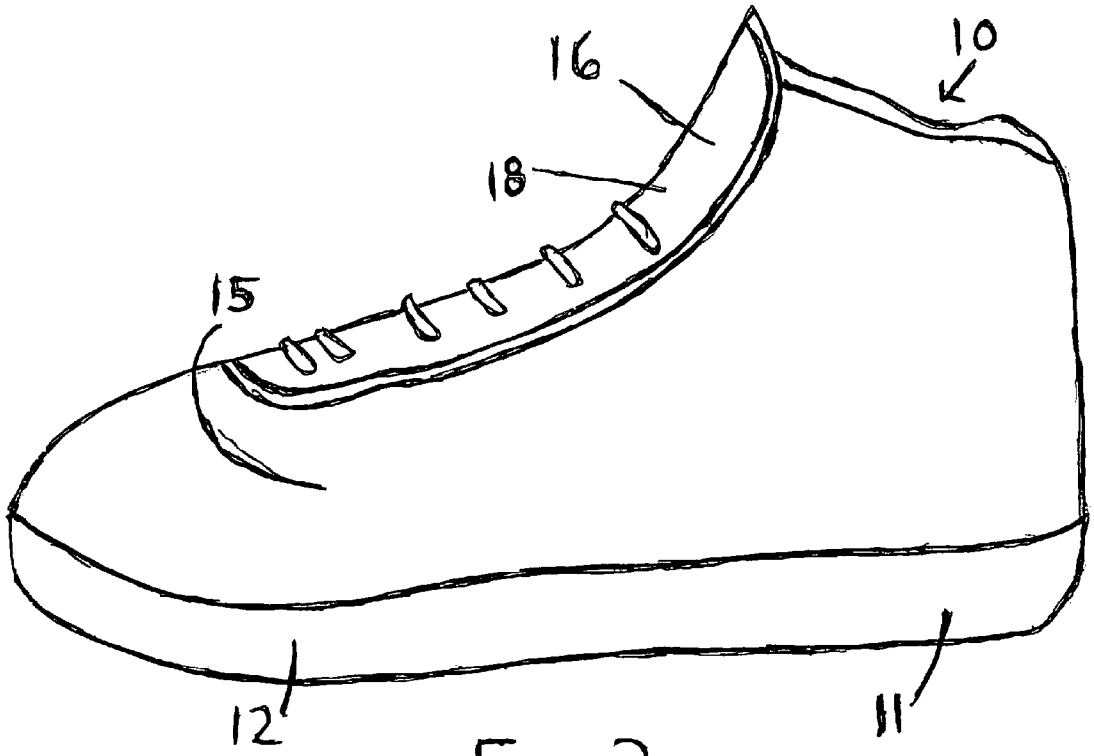
FIG. 2 is a side view of the present invention alternative embodiment.
Figure 3:
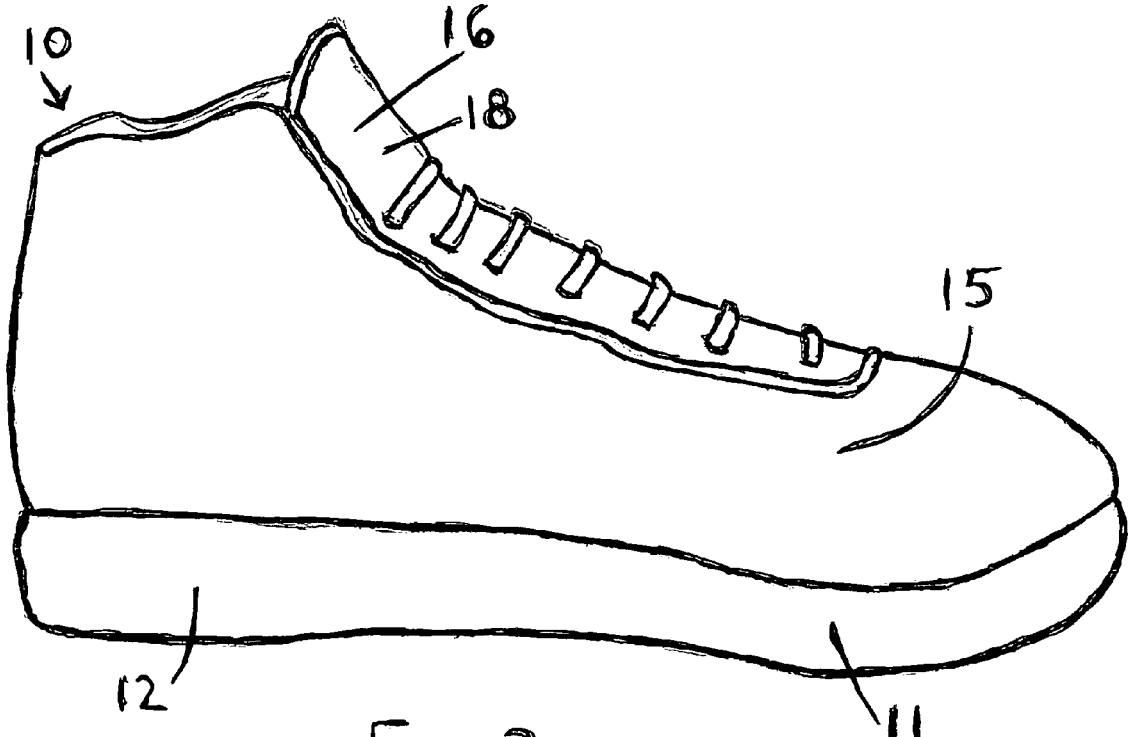
FIG. 3 is a side view of the present invention preferred embodiment.
Figure 4:
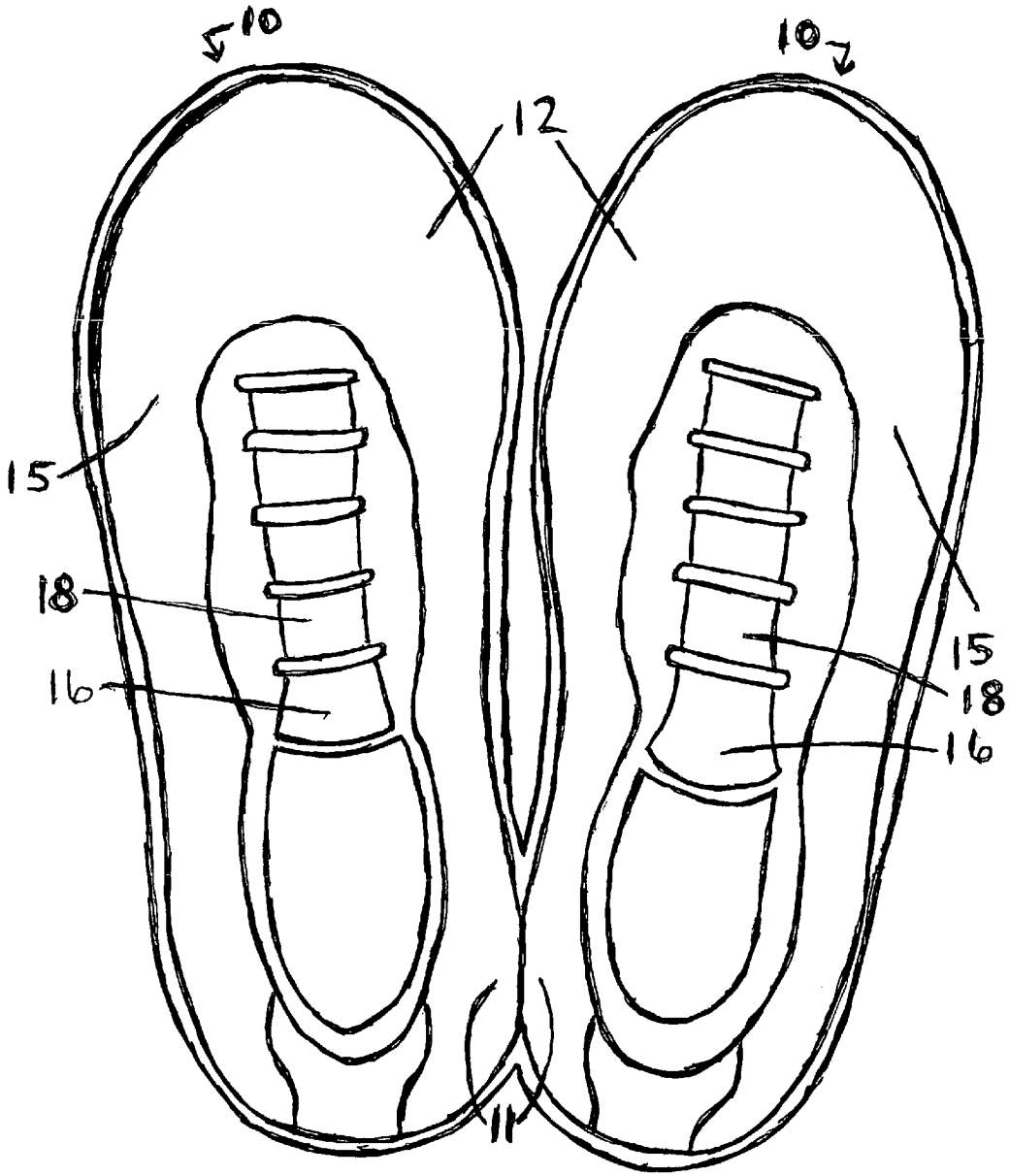
FIG. 4 is a perspective view of the present invention alternative embodiment.
Figure 5:
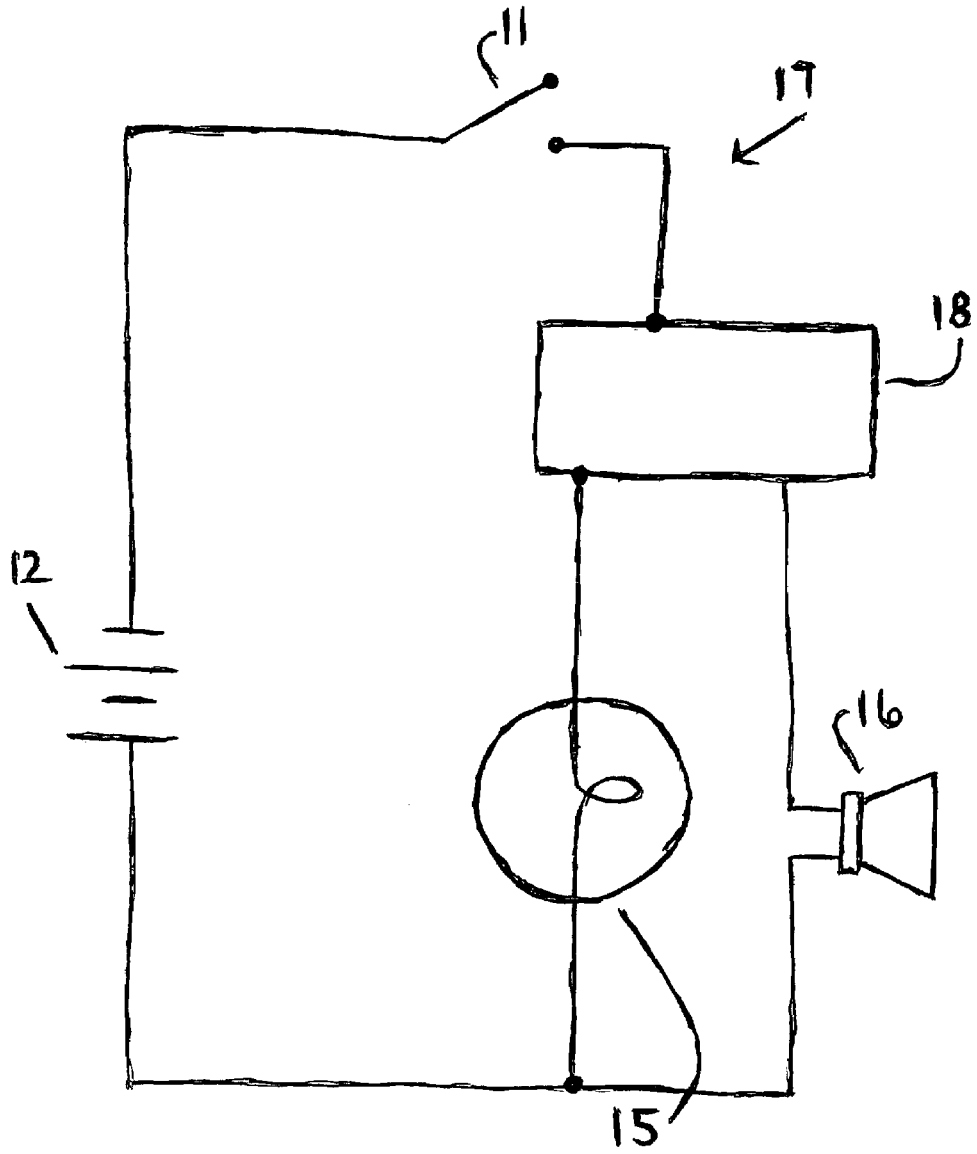
FIG. 5 is a schematic of the current embodiment of the circuit.

Those drawings are merely examples and are not intended to limit the invention in any way.

SUMMARY

The present invention relates to a children's shoe for use in connection with enabling children to put their shoes on the right feet by holding them together in hands.

The smart shoe has particular utility in connection with young children, a confidence building shoe making it easy to put shoes on the right feet every time.

In view of the foregoing disadvantages in the known types of shoes now present, this present invention provides an improved children's shoe and over comes the disadvantages of putting shoes on the wrong feet.

Many children are finding it to be most difficult trying to decide which shoe goes on which foot, and some parents are not always available or they are too busy and can't assist children in putting shoes on the right feet.

Therefore a need exists for a new and improved children's shoe which can be used by children when dressing without the assistance of parents, the present invention fulfills this need.

It is another object of the present invention is to provide a shoe that is durable and reliable construction.

An further object of the present invention is to provide a children's shoe which is susceptible of a low cost of manufacture with regard to both materials and labor, which is then susceptible of low cost to the consuming public.

Yet another object of the present invention is to provide a children'shoe with a learning process of matching shoes up big toe to big toe before putting them on.

In the prior art I have found none to make provision for aiding children in putting shoes on the right feet without the assistance of parents.

Therefore, the need exists for the present invention for use in connection with children learning to put shoes on the right feet, independently at an early age.

In a preferred imbodiment, the smart shoe essentially comprises a big toe to big toe engaging portion with a pressure-activated switch connected to a battery and circuit with an electrical connection to a light that lights when switch is activated.

The smart shoe further comprises a heel to heel engaging portion with a pressure activated switch connected to a battery and circuit with an electrical connection to a speaker and microprocessor with a memory that enables an announcement or other distinctive sounds to be emitted from a speaker.

I claim:

1. A shoe comprising:

A bottom and medial and lateral side portions, the medial side having a toe portion and a heel portion, said portions having a toe engaging portion and a heel engaging portion which are the portions of the shoe that would contact the same portions of a shoe paired with said shoe when a pair of shoes are properly oriented, a switch located on the medial side at the toe or heel engaging portion, at least one light connected to said switch by a light circuit, wherein when a pair of shoes are properly oriented and pressed together such that the toe and/or heel engaging portions are pressed together, the switch will be activated to notify a user that the shoe are properly oriented.

2. The smart shoe of claim 1 further comprises a sound of emitting circuit connected to said switch that emits a sound when said switch is activated.

3. The smart shoe of claim 1 wherein said engaging portions are highlighted in many different colors, shapes, designs, or logos.

4. The smart shoe of claim 3 wherein said engaging portions are highlighted are indicators identifying said switch.

5. A shoe comprising:

A bottom and medial and lateral side portions, the medial side having a toe portion and a heel portion, said portions having a toe engaging portion and a heel engaging portion which are the portions of the shoe that would contact the same portions of a shoe paired with said shoe when a pair of shoes are properly oriented, a switch located on the medial side at the toe or heel engaging portion, at least one speaker connected to said switch by a sound circuit, wherein when a pair of shoes are properly oriented and pressed together such that the toe and/or heel engaging portions are pressed together, the switch will be activated to notify a user that the shoe are properly oriented.

6. The smart shoe of claim 5, wherein said sound emitting circuit further comprises a memory connected to said speaker that enables an announcement or other distinctive sounds to be emitted from said speaker.

7. The smart shoe of claim 5 wherein the circuit further comprises a light connected to said switch, wherein an electrical connection between said light and said battery is formed when said switch is activated.

8. The smart shoe of claim 5 wherein said speaker is a buzzer.

9. The smart shoe of claim 5 wherein said switch is pressure activated.

* * * * *